United States Patent [19]

Russell et al.

[11] 4,412,202

[45] Oct. 25, 1983

[54] ELECTRIC CIRCUIT INTERRUPTING APPARATUS

[75] Inventors: William H. Russell, Stockbridge; Robert D. Ball, Tucker, both of Ga.

[73] Assignee: Kearney-National, Inc., Atlanta, Ga.

[21] Appl. No.: 303,504

[22] Filed: Sep. 18, 1981

[51] Int. Cl.[3] ..... H01H 71/20

[52] U.S. Cl. ..... 337/171; 337/172

[58] Field of Search ..... 337/168, 169, 170, 171, 337/173, 172

[56] References Cited

U.S. PATENT DOCUMENTS 3,447,114 5/1969 Frink et al. ..... 337/171

3,614,700 10/1971 Beard et al. ..... 337/171 X 3,827,010 7/1974 Cameron et al. ..... 337/171 X

*Primary Examiner*—George Harris

*Attorney, Agent, or Firm*—Rodgers & Rodgers

[57] ABSTRACT

An electric circuit interrupter arranged to interrupt overload currents and having a pair of relatively movable normally closed disconnect contacts is associated with an electric circuit interrupter arranged to interrupt load currents and having a pair of relatively movable normally closed contacts forming a parallel circuit to the disconnect contacts only during opening of said disconnect contacts so as to prevent arcing at said disconnect contacts during opening thereof.

10 Claims, 9 Drawing Figures

ELECTRIC CIRCUIT INTERRUPTING APPARATUS

TECHNICAL FIELD

This invention relates to circuit interrupters and more particularly to an arrangement of a pair of circuit interrupters one of which is especially adapted to interrupt overload currents and the other of which is adapted to interrupt load currents.

BACKGROUND ART

U.S. Pat. No. 3,876,849, Electric Circuit Interrupter, issued Apr. 8, 1975 and owned by the assignee of this invention discloses an electric cutout associated with an auxiliary circuit interrupter. While the arrangement of U.S. Pat. No. 3,876,849 functions satisfactorily, the auxiliary interrupter is arranged so that current flows therethrough during a circuit closing operation and while the cutout is closed. Thus it is possible that the load circuit interrupter could be damaged if the circuit being closed is grounded or short circuited in some manner. Also in the arrangement of U.S. Pat. No. 3,876,849 and in other similar designs there is an element of interference with the normal operation of the cutout due to coaction with the auxiliary interrupter. This interference could result in a condition in which the cutout might appear to be closed but in which its disconnect contacts would not be engaged. This situation could result in damage to the load break interrupter.

DISCLOSURE OF THE INVENTION

According to this invention in one form a load break interrupter is arranged so as to accommodate the flow of current therethrough only during a load breaking operation and the load break interrupter is isolated from the circuit when the associated cutout or other device is fully closed or during closing operations of such cutout or other device. Thus a first electric circuit interrupter such as an electric cutout having disconnect contacts and arranged to interrupt overload currents is associated with a second electric circuit interrupter arranged to interrupt load currents and which forms a parallel circuit to the disconnect contacts of the electric cutout only during opening of the disconnect contacts so as to prevent arcing at the disconnect contacts during opening thereof. In accordance with a feature of this invention, the load break interrupter is constructed so as always to be fully opened or fully closed with no intermediate position.

BEST MODE OF CARRYING OUT THE INVENTION

Figure 1:
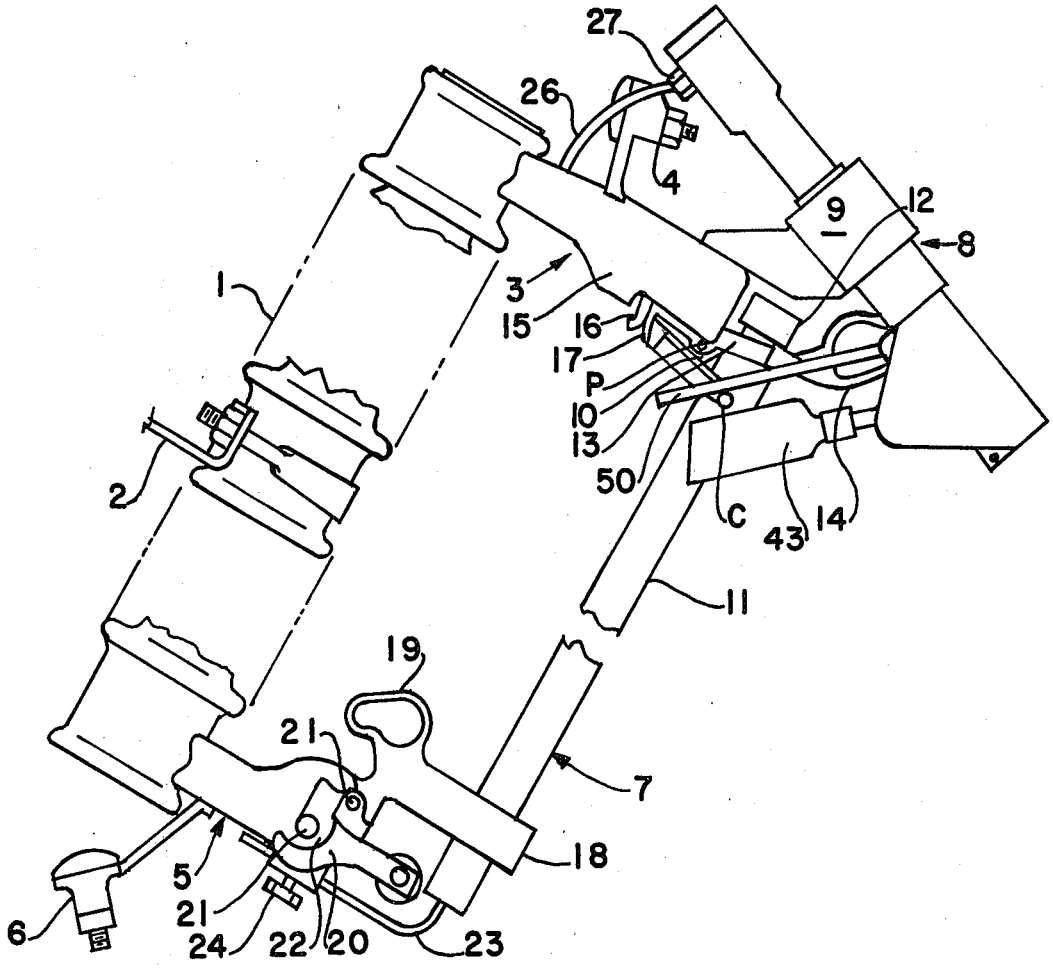
FIG. 1 is a side view of an overload interrupter such as a cutout and of a load break interrupter mounted thereon and which shows the parts in closed circuit positions.
Figure 6:
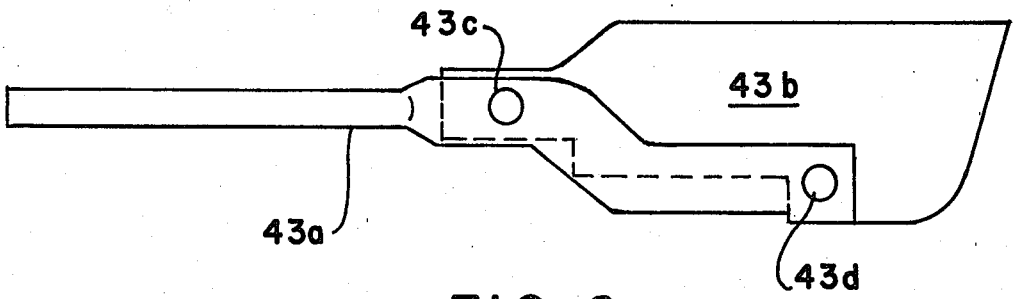
FIG. 6 is an enlarged detailed view of an operating arm for the load break interrupter formed according to one aspect of this invention.

In the drawings the numeral 1 designates a conventional insulator supported by a conventional insulating mounting bracket designated by the numeral 2. As is well known, mounting bracket 2 is supported by any suitable supporting structure such as a power line pole or a cross arm. Secured atop insulator 1 is the top hardware structure 3 of a conventional cutout on which line terminal 4 is mounted. Bottom hardware structure of the cutout is generally designated by the numeral 5 and is secured to the lower end of the insulator 1 in conventional fashion and supports line terminal 6. A fuse holder generally designated by the numeral 7 interconnects the hardware structures 3 and 5 in conventional fashion. An auxiliary load break interrupter generally designated by the numeral 8 is constructed according to this invention and is mounted by means of a mounting bracket 9 secured atop the hardware structure 3 by suitable means not shown in FIG. 1.

Fuse holder 7 includes a conducting collar 10 secured about the fuse tube 11 which is formed of insulating material and in which is mounted a conventional fusible element. The upper end of fuse tube 11 is closed by cap 12 and an operating bracket 13 having an aperture 14 formed at one end is pivotally mounted at P to the collar structure 10. Not shown in the drawings is a yieldable latch structure disposed underneath the sleet hood 15 and which is arranged to engage an appropriate abutment formed on collar 10. Conducting contacts 16 are yieldably mounted underneath sleet hood 15 and cooperate with contact 17 which forms a part of the electric cutout and which is electrically connected with the fusible element disposed within fuse tube 11. Contacts 16 and 17 are herein sometimes referred to as disconnect contacts of the overload interrupter.

At the lower end of the fuse holder 7 a collar structure 18 is secured about the lower end of fuse tube 11 and includes an aperture 19 formed therein. A hinge element 20 is pivoted at 21 to collar 18 and is provided with a pair of trunnions 21 arranged to engage the jaws 22 of the lower structure 5. Extension 23 of the fusible element disposed within the fuse tube 11 is secured to the hinge element 20 by means of a set screw 24.

The circuit through the cutout as described above includes the line terminal 4, sleet hood 15, disconnect contacts 16 and 17, collar 10, the fusible element not shown in the drawings but which is disposed within fuse tube 11, extension 23 of the fusible element, hinge 20, jaw structure 5 and terminal 6.

Figure 5:
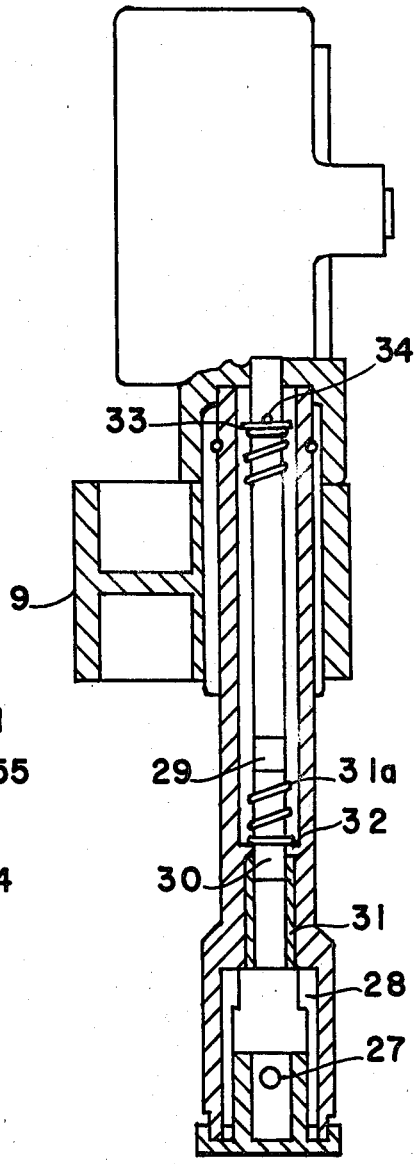
FIG. 5 is an enlarged cross sectional view of a load break interrupter as shown in FIG. 4 but which is taken from a different vantage point.
Figure 7:
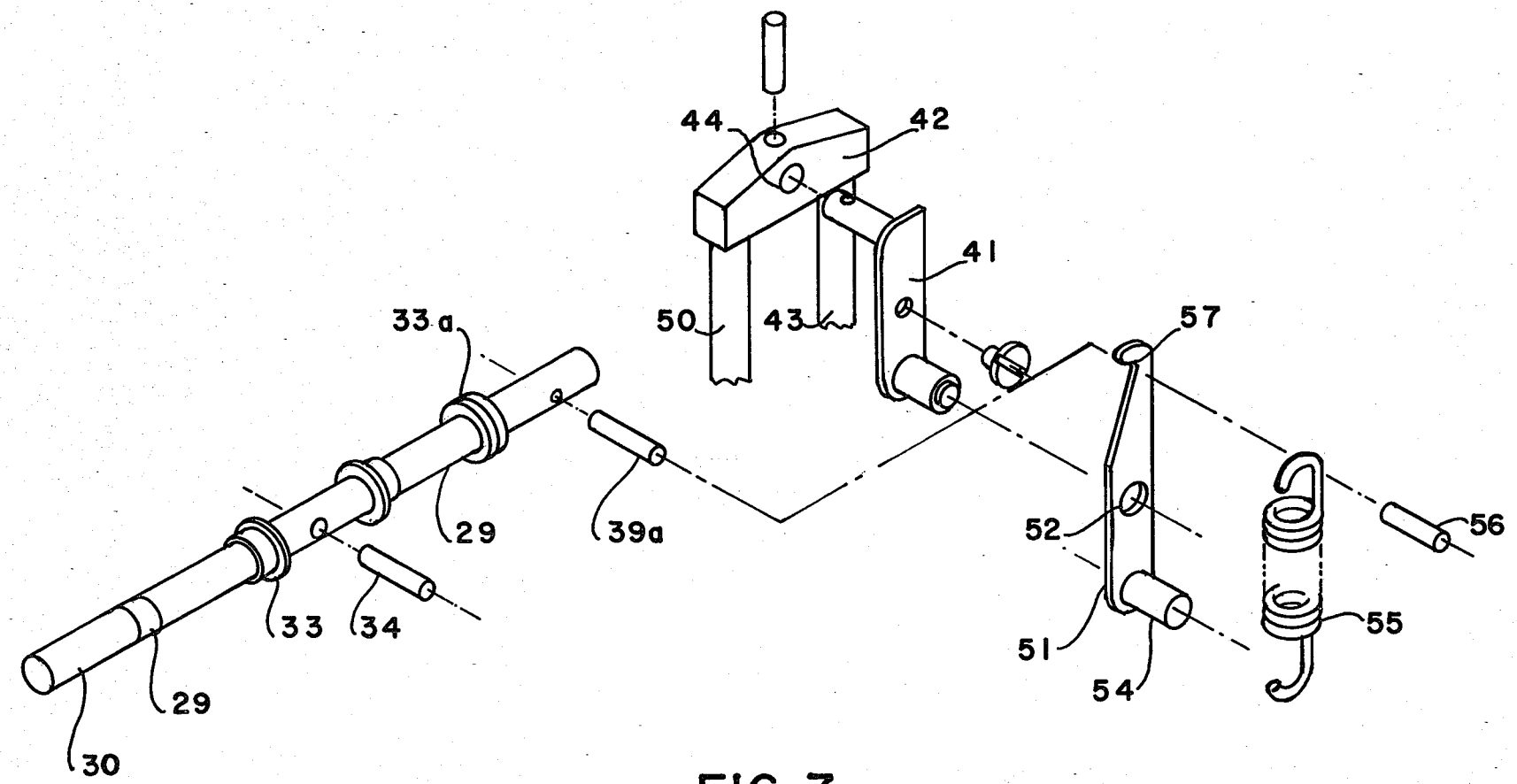
FIG. 7 is an exploded view of a portion of the structure of FIG. 4.

One terminal of the load break interrupter is interconnected with sleet hood 15 by means of conductor 26 and connecting bolt 27. Connecting bolt 27 shown in FIGS. 1 and 5 forms a connection between conductor 26 and the finger contact structure 28 best shown in FIG. 5. Movable contact 29 of the load break interrupter is provided with an end portion 30 formed of gas evolving insulating material in conventional fashion and is guided by sleeve 31 also formed of gas evolving insulating material into and out of cooperative engagement with the finger contact structure 28 in order to make and break an electric circuit.

Movable contact 29 is biased upwardly towards open position by the compression spring 31*a* the lower end of which is seated in the ledge structure 32 and the upper end of which bears against washer 33 held on the movable contact 29 by means of a pin 34.

Figures 2, 3:
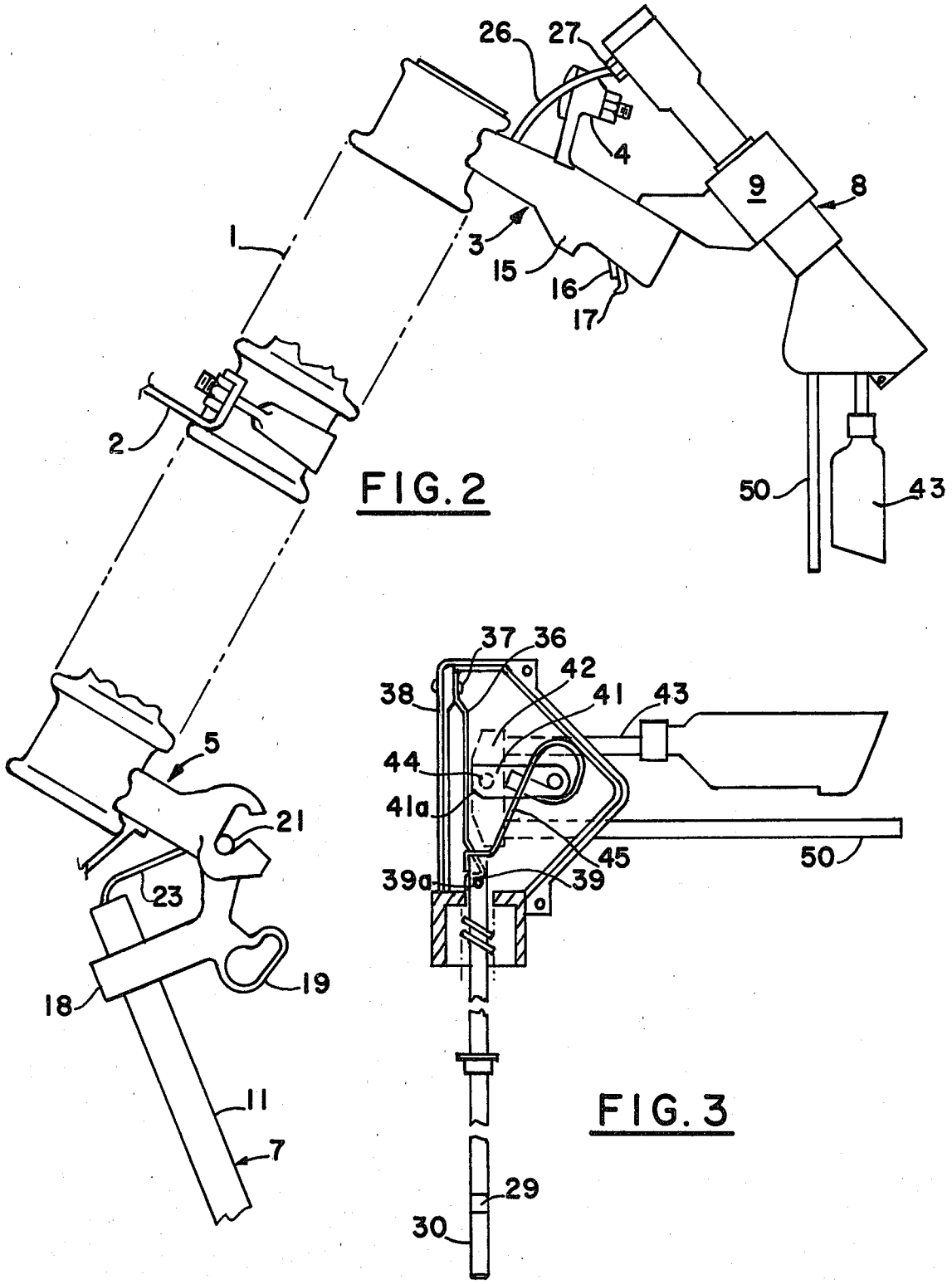
FIG. 2 is a view similar to FIG. 1 but which shows the apparatus in open circuit condition.
FIG. 3 is an enlarged view partially in section of certain parts of the load break interrupter.

The movable contact 29 is held in the circuit closed position wherein the lower end of contact 29 is in electric contact with the finger contact 28 by means of the latch mechanism best shown in FIG. 3 and which comprises a latch 36 secured by bolt or rivet 37 to the housing structure 38 at its upper end and which is provided with an offset latching surface 39 at its lower end. Surface 39 engages a pin 39*a* at the upper end of slidable contact 29 to hold that contact closed.

Latch 36 is movable to its latch releasing position toward the left as viewed in FIG. 3 by means of the latch releasing element 41 which is rigidly secured to operating element 42 which in turn is rotated by operating arm 43 about pivot 44 secured to the housing structure. Operating arm 43 is rigidly secured at its left hand end to operating element 42. In order to release the latch 36 and to allow the movable contact 29 to move quickly upward under the action of its biasing spring 31*a*, the operating arm 43 is rotated in a counterclockwise direction as viewed in FIGS. 1, 2 and 3. Such operating motion may be imparted to operating arm 43 by the conductor C best shown in FIG. 1 and forming a part of the conducting collar 10 secured atop the fuse tube 11 so that normal operation of the cutout due to an overload current which results when the fusible element disposed within the fuse tube 10 melts causes clockwise rotation of the hinge element 20 about the trunnions 21 thus allowing the fuse holder 7 and structure associated therewith to move downwardly thus to disconnect the disconnect contacts 16 and 17. Following overload interruption the subsequent downward movement of the fuse holder 7 causes the transverse conductor C to engage the operating arm 43 and to swing that arm in a counterclockwise direction about pivot 44 to the position shown in FIG. 4 thus causing the contacts of the load break interrupter to separate under the action of biasing spring 31*a* due to release of latch spring 36. This operation positions the arm 50 in the proper position for subsequent reclosing.

Opening of the load break interrupter may also be effected by a conventional hook stick which is inserted into the aperture 14 formed in the operating lever 13 followed by a downward pull on the hook stick causing clockwise rotation of element 13 about its pivot P which in turn causes the fuse holder to swing in a clockwise direction about the trunnions 21 due to the release action of the latch not shown in the drawings but which is released by clockwise rotation of element 13. Such downward and rotary movement of the fuse holder 7 about the trunnions 21 causes the conductor C to engage the operating arm 43 and to cause the contacts 28 and 29 of the auxiliary load break interrupter 9 to separate. Of course the interrupter 8 forms a shunt around disconnect contacts 16 and 17 so that no arcing occurs at the contacts 16 and 17. This circuit includes conductor 26, contacts 28 and 29, flexible wire 45 which connects contact 29 with latch 41, element 42, operating arm 43 and conductor C.

In order to close the apparatus from the position shown in FIG. 2 to that shown in FIG. 1, a hook stick is simply inserted into the aperture 14 formed in element 13 followed by an upward push which causes the entire fuse holder to rotate in a counterclockwise direction as viewed for example in FIG. 1 about the trunnions 21. This action causes the conductor C to ride between the operating arm 43 which occupies the position shown in FIG. 2 and the insulating arm 50. As is apparent from FIG. 3 insulating arm 50 is secured to element 42 so that rotation of the fuse holder 7 in a counterclockwise direction about the trunnions 21 followed by engagement of conductor C with the right hand portion of insulating arm 50 causes that arm as well as element 42 associated therewith to rotate in a clockwise direction about pivot 44.

Such rotation also imparts rotation to latch releasing element 41 and moves that element to a position in which the lower rounded corner 41*a* is in contact with latch 36 so that the latch is free to engage pin 39*a* in the upper end of contact 29 when that contact is moved to its closed position.

Figure 4:
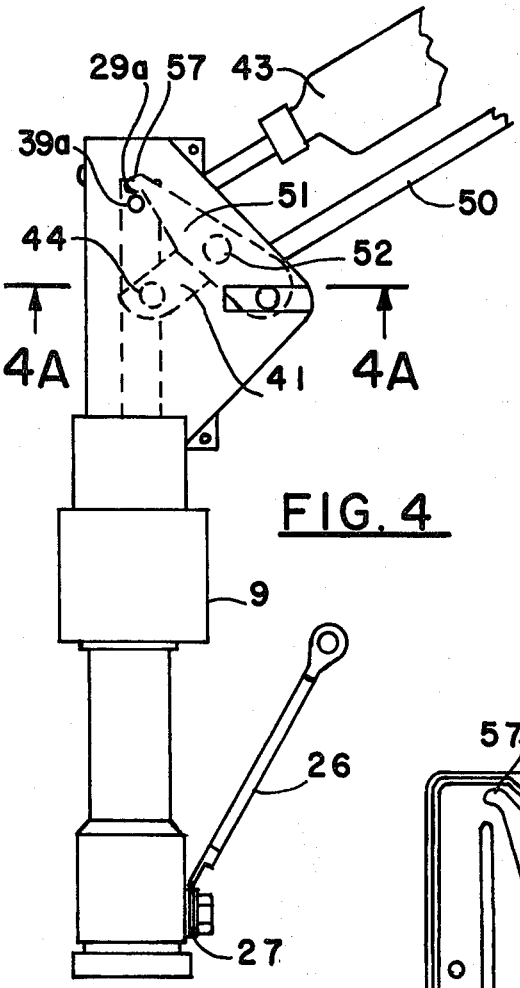
FIG. 4 is an enlarged side view of a load break interrupter constructed according to this invention.
Figure 4B:
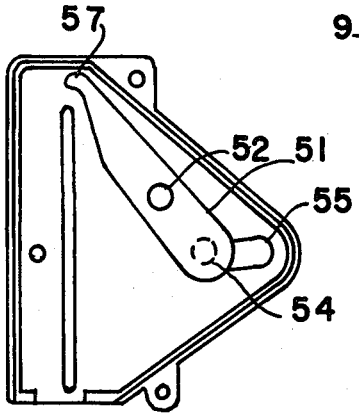
FIG. 4B is an enlarged view of the upper portion of 4A with the cover and certain parts removed.
Figure 4A:
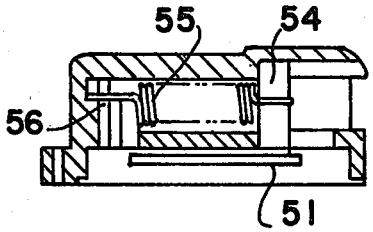
FIG. 4A is a cross sectional view along the line designated 4A—4A in FIG. 4.

For the purpose of closing the contact 29 of the load break interrupter, reset arm 51 shown in dotted lines in FIG. 4 and in solid lines in FIG. 4B swings in a counterclockwise direction about its pivot 54. Reset arm 51 is affixed to latch release element 41 at point 52. Latch release element 41 is rotatable about the fixed pivot 44. Secured to the lower right hand end of reset arm 51 as shown in FIGS. 4A and 4B is a pivot pin 54 which is slidable within a slot 55 formed in the housing structure. Such sliding motion toward the right of pin 54 is in opposition to tension spring 55 which is connected with pin 54 at its right-hand end as shown in FIG. 4A and which is secured at its left-hand end to the pin 56 which is fixed within the housing structure. Thus rotation of reset arm 51 in a counterclockwise direction about its pivot 54 caused by clockwise rotation of latch 41 about pivot 44 results in engagement of the upper left hand end 57 of the reset arm 51 with pin 39*a* near the upper end of the contact 29. Continued counterclockwise rotation of reset arm 51 as shown in FIG. 4 caused by clockwise rotation of operating lever 50 about its pivot 44 results in downward movement of contact 29 and the resulting compression of its operating spring 31*a*. When the latch structure 39 rides over pin 39*a* near the upper end of contact 29 the load break contacts are latched closed and occupy the positions shown in FIG. 3.

Since the operating lever 50 is formed of insulating material, it is clear that there is no conduction of current into the load break interrupter 8 while in its closed position or during a closing operation of that interrupter.

Opening of the device as by means of a hook stick inserted into the aperture 14 of operating lever 13 results in engagement of the conductor C with the conducting portion 43*a* of the operating arm 43 so that after the disconnect contacts 16 and 17 are separated, a circuit through the auxiliary load break interrupter is effected by virtue of the operating arm 43*a* which is in contact with conductor C. The right-hand portion of operating arm 43 designated by the numeral 43*b* is formed of insulating material secured to the conducting part 43*a* by pins 43*c* and 43*d*. The purpose of the insulating element 43*b* is to insure that no circuit will be established between the conductor C and the operating arm 43 during closing of the auxiliary load break interrupter. This feature insures that closing of the auxiliary interrupter on a short circuited condition will not result in a flow of current and the resulting possible damage to associated apparatus or injury to operating personnel.

If the operating arm for any reason is not properly positioned for closing such for example, the closed position shown in FIG. 1 and the fuse holder is open as shown in FIG. 2, the insulating portion 43*b* of operating arm 43*a* forms an effective abutment which is engaged by conductor C as an attempt is made to close the fuse-holder 7. By this means the disconnect contacts 16 and 17 are prevented from making contact and with adequate air insulation to prevent the striking of an arc between 17 and hood 3.

INDUSTRIAL APPLICABILITY

An arrangement constructed according to this invention is well suited for use in protecting distribution circuits against overload conditions and also provides for interruption of normal load currents as may be desired by an operator. While the invention is shown in connection with an electric cutout, it is not limited thereto and may comprise the combination of a load break interrupter formed according to this invention and an electric switch or fuse.

We claim:

1. In combination a first electric circuit interrupter having a pair of relatively movable normally closed disconnect contacts and a fusible element disposed in a fuse holder and arranged to interrupt an overload current, and a second electric circuit interrupter having a pair of relatively movable normally closed circuit interrupting contacts arranged to interrupt load currents, said second interrupter, forming a parallel circuit to said disconnect contacts only during opening of said disconnect contacts so as to prevent arcing at said disconnect contacts during opening thereof and arranged to insure that said fuse holder will open if the disconnect contacts of the first interrupter are not engaged and latched closed following a closing operation.

2. The combination of claim 1 wherein said operating arm is formed at least in part of conducting material and wherein said operating arm is electrically connected with one of said interrupting contacts.

3. The combination of claim 1 wherein said operating arm is formed in part of insulating material arranged to prevent engagement of said conductor with a conducting part of said operating arm while said operating arm of said second interrupter is disposed in a closed position and said first interrupter is in the open position and an attempt is made to close the first interrupter.

4. The combination of claim 1 wherein said operating arm is formed in part of insulating material and arranged to prevent closing of said disconnect contacts of the first interrupter when said second interrupter is disposed in closed position and said first interrupter is in the open position and an attempt is made to close the first interrupter.

5. The combination of claim 1 wherein a conductor mounted on and movable with a movable one of said disconnect contacts is arranged to engage an operating lever of said second interrupter so as to effect closing of said interrupting contacts in coordination with closing movement of said movable disconnect contact.

6. The combination of claim 5 wherein said operating lever is formed of insulating material so as to prevent the flow of current through said second interrupter during closing of said disconnect contacts.

7. The combination of claim 1 wherein opening movement of said disconnect contacts is responsive to melting of said fusible element and effects opening of said interrupting contacts.

8. An electric circuit interrupter comprising a pair of relatively movable contacts, latch means for holding said contacts closed, biasing means for opening said contacts upon release of said latch means, and an operating arm formed in part of conducting material electrically interconnected with one of said contacts and operable to release said latch means, said operating arm being formed in part of insulating material to prevent undesired electrical contact between said operating arm and another electrically conductive circuit element.

9. An interrupter according to claim 8 wherein means including an operating lever formed of insulating material is arranged to engage and move a movable one of said contacts to its closed position in opposition to the force of said biasing means.

10. In combination a first electric circuit interrupter having a pair of relatively movable normally closed disconnect contacts and a fusible element disposed in a fuse holder and arranged to interrupt an overload current, a second electric circuit interrupter having a pair of relatively movable normally closed circuit interrupting contacts arranged to interrupt load currents, said second interrupter forming a parallel circuit to said disconnect contacts only during opening of said disconnect contacts so as to prevent arcing at said disconnect contacts during opening thereof and arranged to insure that said fuse holder will open if the disconnect contacts of the first interrupter are not engaged and latched closed following a closing operation, and a conductor connected with a movable one of said disconnect contacts and arranged to engage an operating arm of said second interrupter so as to effect separation of said interrupting contacts in coordination with opening movement of said movable disconnect contact.

* * * * *